US005213518A

United States Patent [19]

Weidler

[11] Patent Number: 5,213,518

[45] Date of Patent: May 25, 1993

[54] CONNECTING ELECTRICAL BUS BARS TO ELECTRICAL CIRCUITRY

[75] Inventor: Charles H. Weidler, Lancaster, Pa.

[73] Assignee: AMP Incorporated, Harrisburg, Pa.

[21] Appl. No.: 843,787

[22] Filed: Feb. 28, 1992

[51] Int. Cl.[5] ..... H01R 25/16

[52] U.S. Cl. ..... 439/211; 439/212

[58] Field of Search ..... 439/207, 211, 212, 215, 439/686, 214, 208, 209, 210, 216

[56] References Cited

U.S. PATENT DOCUMENTS

| | | | |
|---|---|---|---|
| 3,263,131 | 7/1966 | Rowe | 439/212 |
| 3,634,809 | 1/1972 | Houilles | 439/214 |
| 4,664,456 | 5/1987 | Blair et al. | 339/14 P |
| 4,753,615 | 6/1988 | Weidler et al. | 439/775 |
| 4,761,144 | 8/1988 | Hunt, III et al. | 439/545 |
| 4,812,133 | 3/1989 | Fleak et al. | 439/248 |
| 4,824,387 | 4/1989 | deJong et al. | 439/248 |
| 4,845,589 | 7/1989 | Weidler et al. | 361/342 |
| 4,995,826 | 2/1991 | Schieferly | 439/347 |
| 5,073,120 | 12/1991 | Lincoln et al. | 439/215 |
| 5,080,604 | 1/1992 | Rider et al. | 439/357 |
| 5,092,787 | 3/1992 | Wise et al. | 439/215 |
| 5,131,860 | 7/1992 | Bogiel | 439/211 |

*Primary Examiner*—Gary F. Paumen
*Attorney, Agent, or Firm*—David L. Smith

[57] ABSTRACT

A bus bar carrying electrical plug connector (2) for mating with a receptacle connector (4) mounted to float in the back panel (P2) of a drawer containing a power supply distribution module, comprises the rear insulating housing member (6), a bus bar and contact assembly (8) and a front insulating housing member (10). The bus bar assembly (8) comprises bus bars (32) from a forward longitudinal edge of each of which projects a socket contact (34), the opposite edge of each bus bar (32) being formed with a notch (40). The rear housing member (6) has a back wall (12) provided with a row of alternating merlons (28) and ribs (30). The front housing member (10) has through cavities (52) each for receiving a respective contact (34) and rearwardly opening slots (60) communicating with the cavities (52) for receiving the bus bars (32). When the housing members (6 and 10) are assembled together about the bus bar assembly (8), the ribs (30) engage in the notches (40) in the bus bars (32) and the merlons (28) engage opposite side faces of the bus bars (32) whereby the bus bars are supported in the connector (2).

24 Claims, 16 Drawing Sheets

CONNECTING ELECTRICAL BUS BARS TO ELECTRICAL CIRCUITRY

FIELD OF THE INVENTION

This invention relates to an electrical connector for electrically connecting at least one electrical bus bar to external electrical circuitry, and in particular to a two part housing for encircling the bus bar or enclosing the bus bar at the location at which the connector is positioned.

BACKGROUND OF THE INVENTION

There is disclosed in U.S. Pat. No. 4,845,589 a bus bar assembly comprising a frame in which circuit modules are slidable on rails towards and away from a power bus bar, the circuit modules being arranged one above the other. Each module has receptacle in the form of a tulip contact for receiving the bus bar when the module, which is in the form of a drawer, has been slid to a home position in the frame. The bus bar is incorporated in the frame and each receptacle is secured to a guide fork for guiding the receptacle into mating relationship with the bus bar. The guide fork is fixed to a slide block mounted on the module for sliding movement transversely of the rails to take up play between the module and the rails. Drawer connector assemblies comprising a pair of mating electrical connectors are also disclosed in U.S. Pat. No. 4,664,456 and U.S. Pat. No. 4,761,144 but these assemblies do not include the bus bar therein.

SUMMARY OF THE INVENTION

This invention is intended to provide an electrical connector which encircles or surrounds at least one power bus bar and supports the same, for mating with an electrical connector mounted in a back panel of a power distribution module drawer.

According to one aspect of the present invention, a bus bar carrying electrical connector for electrically connecting at least one bus bar to an electrical circuit comprises a first and second insulating housing members surrounding said assembly; the connector may also include a bus bar and contact assembly. The bus bar and contact assembly comprises at least one bus bar with an electrical contact projecting from a longitudinal edge of the bus bar, the first insulating housing member receiving the, or each, contact for mating with an electrical contact element connected to the external circuit which may be a power distribution module. The opposite longitudinal edge of said at least one bus bar, and the second insulating housing, have means cooperating to support the bus bar in the connector. The supporting means may comprise a notch in the said opposite longitudinal edge and a projection on the second insulating housing member for engaging in the notch, further projections on the second insulating housing member engaging opposite faces of the bus bar on either side of the notch.

Although, where the connector is to be used with a three phase power supply, the connector will usually support four bus bars, one for each phase and one grounded bus bar, a plurality of smaller connectors each supporting only one bus bar, might be used instead. Where the power supply is a DC power supply, the connector will normally support two bus bars. The projections of the second insulating housing member are preferably provided on a back plate thereof in the form of castellations comprising alternate merlons and crelons, the crelons spanning the merlons of each adjacent pair and the merlons projecting from the back plate to a greater extent than the crelons, whereby ribs in the crelons engage in the notches of the bus bars and the merlons engage the lateral faces of the bus bars.

The first insulating housing member is preferably formed with slots receiving the bus bars so that the assembled parts of the connector form a compact and rigid structure.

According to another aspect of the invention, the bus bar carrying connector is included in a connector assembly comprising a further electrical connector having contacts for mating with the bus bar contacts and being mounted to float in the back panel of the drawer, the bus bar carrying connector being rigidly mounted to a further panel, which may be part of a fixed casing enclosing it, so that the weight of the bus bars is transferred to that panel. The bus bar carrying connector could not, in practice, be mounted in its panel so as to float, in view of the weight of the bus bars.

The invention further relates to first and second insulating housing members per se, for the bus bar carrying connector.

DESCRIPTION OF THE PREFERRED EMBODIMENTS OF THE INVENTION

An electrical connector assembly for making and breaking the supply of power to a drawer module containing circuitry of a computer power supply distribution unit, comprising a panel mounted, four position plug connector 2 and a panel mounted four position receptacle connector 4 will now be described with reference to the Figures, initially FIGS. 1 to 16.

The plug connector 2 is for mounting on a front panel P1 (see FIG. 2) of a fixed casing (not otherwise shown) for accommodating the connector 2. The receptacle connector 4 (see FIG. 8) is for mounting on a rear panel P2 (see FIG. 8) of the draw module which may be slideably mounted in a rack (not shown) of a computer. As explained below, the power supply to the module is completed when the module is operatively positioned in the rack, and is disconnected as the module is withdrawn therefrom.

Figure 1:
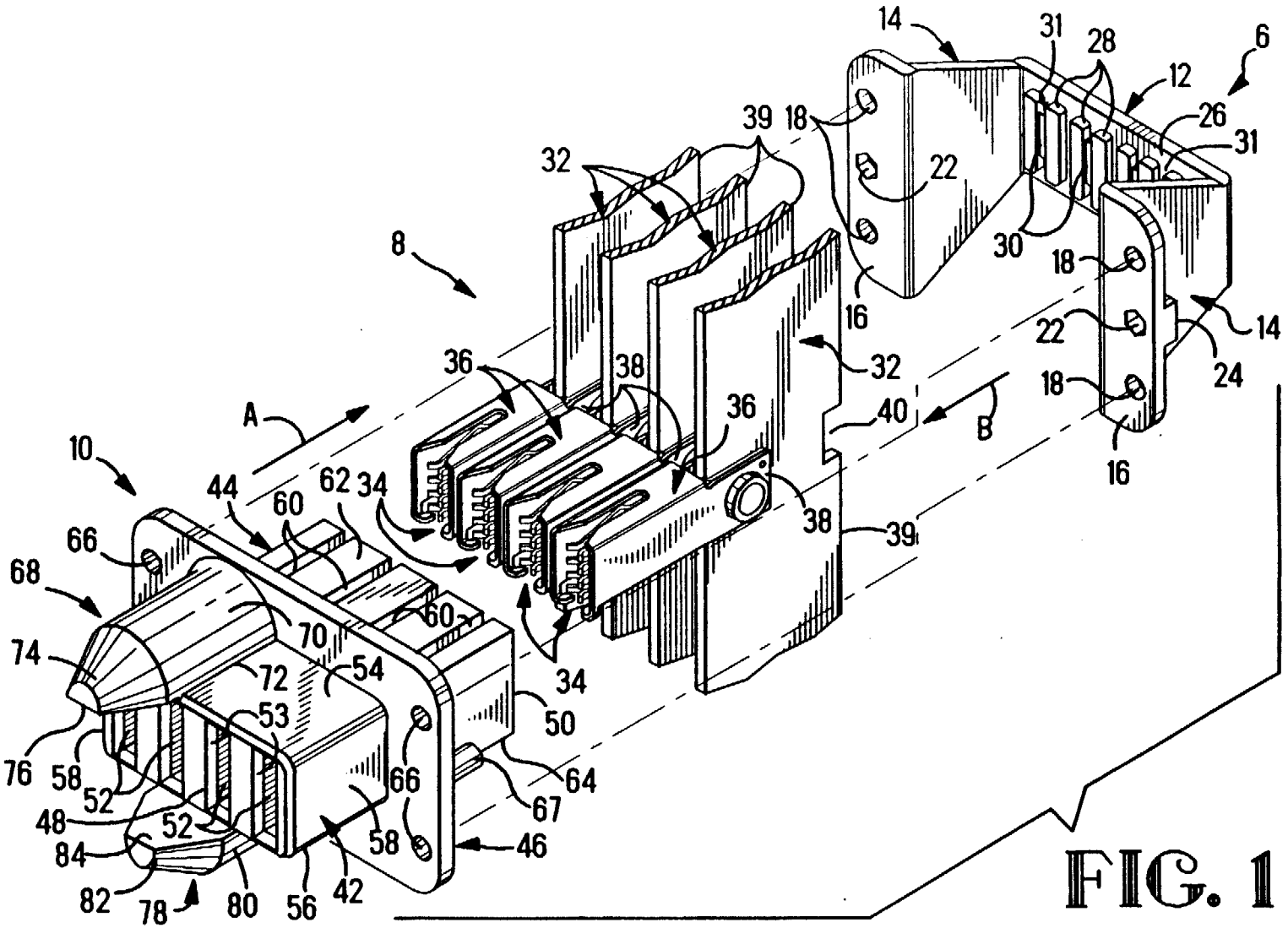
FIG. 1 is an exploded isometric view of a four position bus bar plug connector comprising a front insulating housing member, and intermediate bus bar and tulip contact assembly and a rear insulating housing member.
Figure 2:
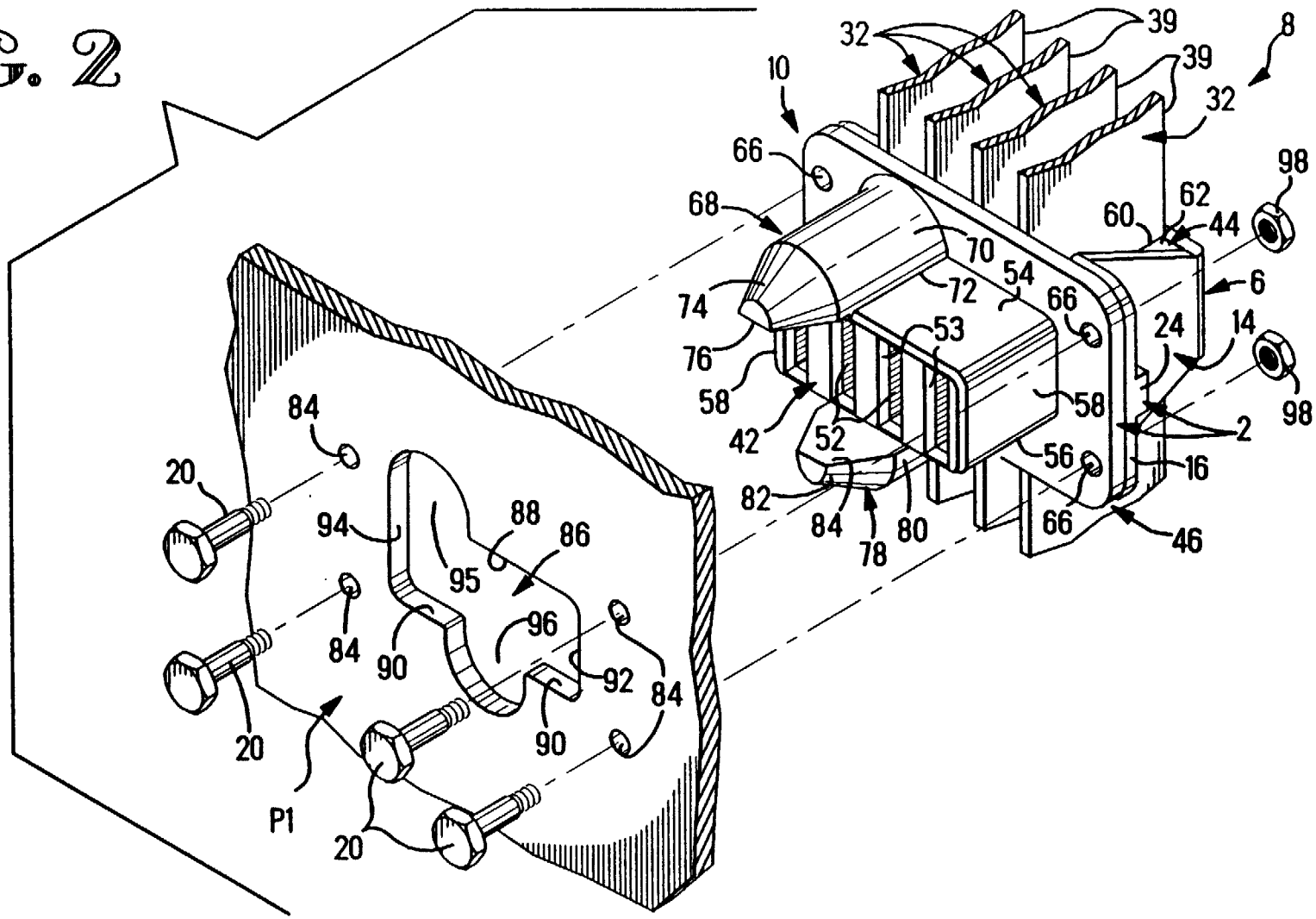
FIG. 2 is an exploded isometric view of the plug connector mounted to a first panel.

The plug connector 2 comprises, as best seen in FIG. 1, a one piece, molded, rear insulating housing member 6 and a one piece, molded, front insulating housing member 10, and may include a bus bar and tulip contact assembly 8. The rear housing member 6 comprises an elongate rectangular back plate 12 from each end of which projects a forwardly extending mounting lug 14 terminating in a mounting flange 16 substantially parallel with the back plate 12. Each mounting lug 14 is formed with a pair of vertically spaced, through holes 18 for receiving mounting bolts 20 (FIG. 2). Each flange 16 has between the holes 18 an aperture 22, which may be of hexagonal cross section as shown in FIG. 1. The aperture 22 extends into a rear projection 24 on the flange 16.

There project from the front face 26 of the back plate 12, a row of parallel, evenly spaced, elongate, transverse projections in the form of merlons 28 of equal length. Between each adjacent pair of merlons 28 is an elongate smaller rib 30 extending up from the floor of a crenel 31 extending parallel to the merlons 28 but being shorter than, and of smaller height than, the merlons 28. Each rib 30 is of equal width to the spacing between the merlons 28 and thus bridges the merlons between which it is disposed.

The bus bar and contact assembly 8 in the preferred embodiment comprises a row of four parallel, spaced, aligned power bus bars 32, and a row of four parallel, spaced, aligned, tulip, tab or receptacle, socket contacts 34, each having a slotted, tab receiving metal cover 36 from which extend a pair of legs 38 are on each side of a respective one of the bus bars 32. Contacts 34 are secured to respective bus bars 32 by locking inserts. Such, tulip socket contacts are described in U.S. Pat. Nos. 4,845,589 and 4,753,615 which are hereby incorporated by reference. Three of the bus bars 32 are connected to respective power supply leads (not shown) of a three phase power supply, the remaining bus bar 32 being grounded. Approximately in line with the cover 36 connected thereto, each bus bar 32 has formed in its rear edge 39, a rectangular notch 40, the notches 40 being identical and being aligned with each other.

The front housing member 10 comprises a laterally elongate forward housing plug part 42, a similarly elongate rear housing part 44 and a flat, substantially rectangular peripheral flange 46 between the housing parts 42 and 44. The housing part 42 has a mating front face 48, the housing part 44 having a tulip contact and bus bar receiving face 50. Open into both of the faces 48 and 50 are a row of four vertically elongate, rectangular, tulip contact receiving cavities 52, each having a tab receiving entrance 53 at the face 48. The housing part 42 has a top wall 54, a bottom wall 56 and side walls 58, all of these walls being adjacent to the mating face 48. The rear housing part 44 is formed with a row of through, bus bar receiving upper and lower slots 60 opening into a top wall 62 and a bottom wall 64, respectively, of the housing part 44. Each slot 60 is aligned with, and communicates with a respective cavity 52. The flange 46 has proximate to each corner thereof, an aperture 66 for receiving a respective bolt 20. There projects from each side of the rear face of the flange 46, a cylindrical protrusion 67 midway between the holes 66 in that side. There extends forwardly from the flange 46, a first alignment member 68 having a rearward portion 70 in the form of a half circular cross section cylinder, the flat side 72 of which is formed integrally with the top wall 54. The member 68 has, projecting forwardly from its portion 70, a nose 74 in the form of a half cone which lies forwardly of the mating face 48. The flat side 76 of the nose 74 faces downwardly. A second alignment member 78 of the housing member 10, has a rearward portion 80 the same semicylindrical shape as the portion 70 of the member 68, projecting forwardly from the flange 46 and beneath the housing part 42. The flat side of rearward portion 80 is formed integrally with the bottom wall 56 of the part 42. There projects forwardly from the rear portion 80 of the member 78, and beyond the mating face 48, a nose 82 of the same semiconical shape as the nose 74. The flat side 84 of the nose 82 faces upwardly, that is to say in the opposite direction of the flat side 76 of the nose 74. The members 68 and 78 are offset longitudinally of the housing part 42, unsymmetrically with respect to the longitudinal center of the walls 54 and 56. In this manner, the alignment members 68 and 78 provide polarization of the front housing member 10 relative to a mating receptacle connector.

As shown in FIG. 2, the panel P1 has four through holes 84 arranged in quadrangular array, and spaced as holes 66 and 18, for receiving respective ones of the bolts 20. Between the holes 84, panel P1 has a cut out 86 having opposite, parallel, top and bottom edge 88 and 90, and end edges 92 and 94, respectively. At one end of the edge 88, the cut out 86 opens upwardly into an arcuate the first alignment member receiving recess 95 of substantially the same cross sectional shape and area as the rearward portion 70 of member 68. Near the other end of the edge 90, the cut out 86 opens downwardly into a second arcuate alignment member receiving recess 96 of substantially the same cross sectional shape and area as the rearward portion 80 of member 78.

Figure 4:
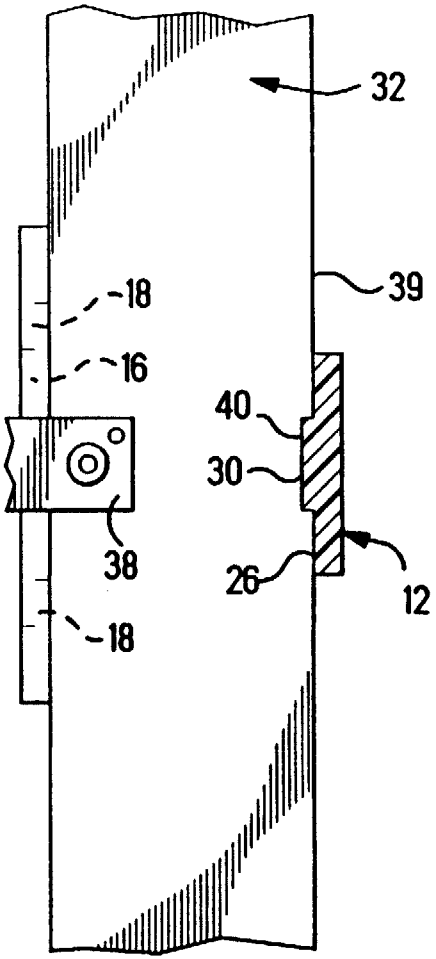
FIG. 4 is a similar view to that of FIG. 3 but showing the rear housing member when assembled to the bus bar and tulip contact assembly.
Figure 3:
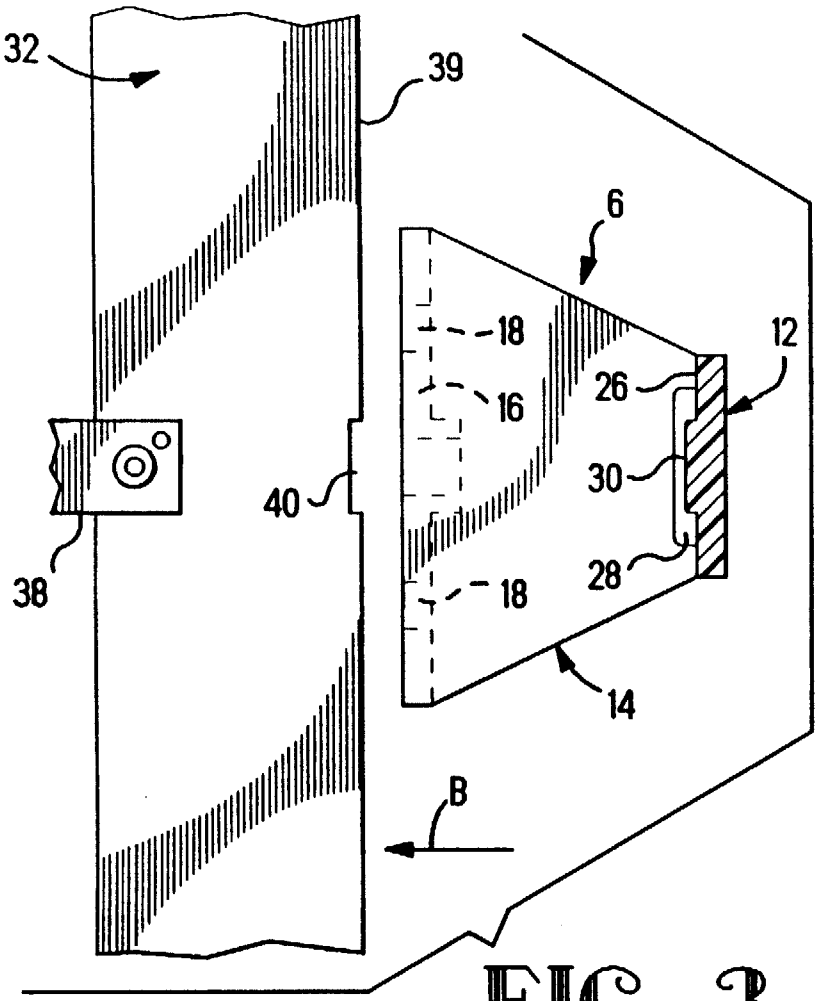
FIG. 3 is a fragmentary side view, shown partly in section, of the rear housing member about to be assembled to the bus bar and tulip contact assembly.

In order to assemble the housing members 6 and 10 to the bus bar and tulip contact assembly 8, each contact 34 with its cover 36 is inserted into a respective cavity 52 of the housing member 10, by way of the face 50, in the direction of the arrow A in FIG. 1, so that each bus bar 32 is received in respective upper and lower slots 60, as shown in FIG. 2. The contacts 34 and their covers 36 are simultaneously received in the housing portion 42, to an extent determined by the abutment of the forward edges of the bus bars 32 against the bottom of the respective slots 60. The housing member 6 is passed over bus bars 32 in the direction of the arrow B in FIGS. 1 and 3 until the rear edge 39 of each bus bar 32, adjacent to the notch 40 therein, is received between the merlons 28 of a respective adjacent pair thereof. At the same time, each rib 30 is snugly received in a respective notch 40 in said rear edge 39, as shown in FIG. 4.

Figure 6:
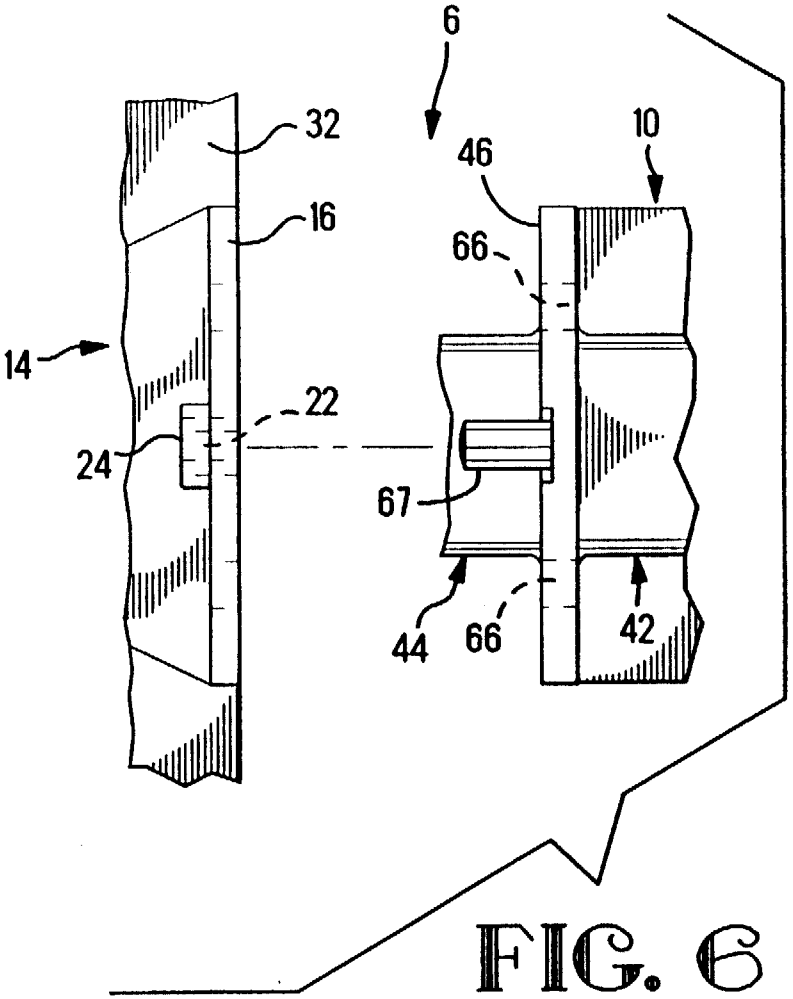
FIG. 6 is a fragmentary side view illustrating details of the front and rear housing members for holding said members together.
Figure 5:
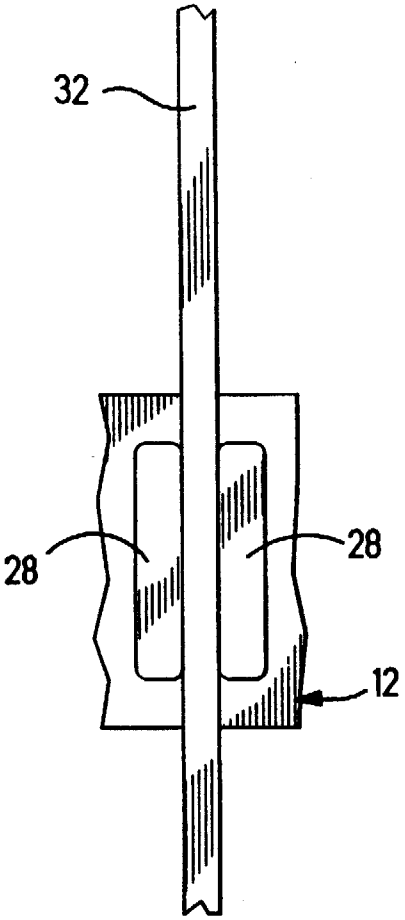
FIG. 5 is an end view of FIG. 4 with parts omitted.
Figure 7:
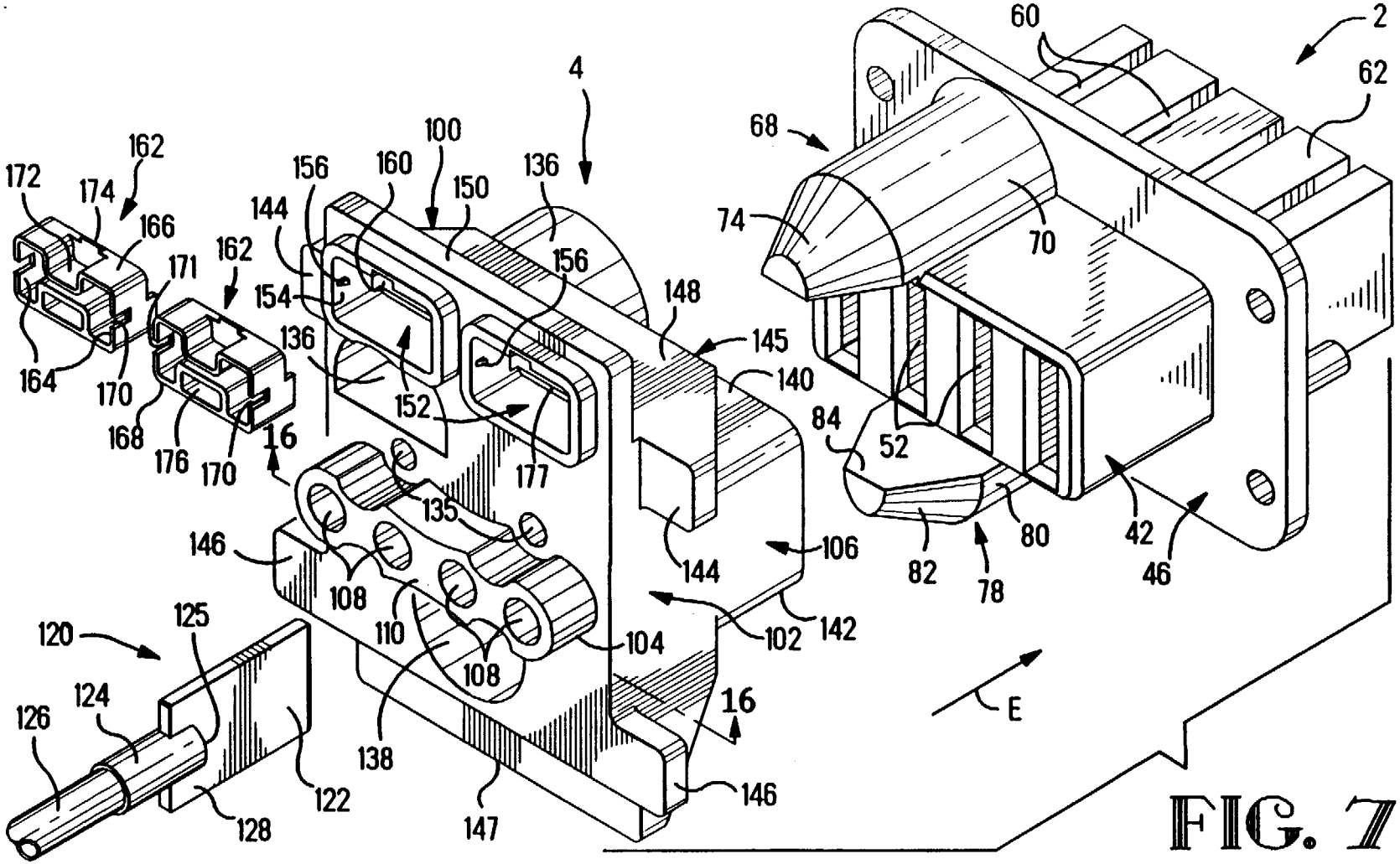
FIG. 7 is an isometric view showing the plug connector, with parts omitted, positioned for mating with a four position receptacle connector with parts exploded therefrom.

As will be apparent from FIG. 6, each cylindrical protrusion 67 of the housing member 10 is received in a respective aperture 22 of the housing member 6. The cylindrical protrusion 67 and the rear projection 24 are so relatively dimensioned that the cylindrical protrusions 67 engage in the flange and rear projection 24 in an interference fit, whereby the housing members 6 and 10 are temporarily held together about the assembly 8 in order to facilitate the mounting, described below, of the connector 2 to the panel P1. Cylindrical protrusions 67 could extend beyond the rear surface of rear projections 24 for heat staking as is known in the art. The merlons 28 maintain the lateral positions of the bus bars 32 so that they cannot move laterally so as to displace the rib 30 from the notches 40, as is apparent from FIG. 5. The weight of each bus bar 32 is supported by a respective rib 30.

With the connector 2 assembled as described above, the forward portions 74 and 82 of the alignment members 68 and 78 are inserted through the alignment member receiving recesses 95 and 96, respectively, of the cut out 86 of the panel P1 assisted by the rounded guide surfaces of the noses 74 and 82. The edges of the alignment member receiving recesses 95 and 96 slide along the rounded surfaces of the respective portions 70 and 80 of the alignment members 68 and 78, respectively, the walls 54 and 56 of the housing member 10 being received between the edges 88 and 90, respectively, of the cut out 86; until the panel P1 bottoms on the flange 46 of the housing member 10. Since the alignment members 68 and 78 are offset from each other longitudinally of the housing part 42, and are disposed on opposite top and bottom walls thereof, as described above, the housing member 10 can be assembled to the panel P1 only in a single correct orientation with respect thereto. In this manner, the offset alignment members provide a polarization function with respect to the panel cutout 86, in addition to providing as mentioned above a polarization function relative to a mating connector. When the connector 2 has been assembled as described above, to the panel P1, the bolts 20 are inserted through the respective aligned sets of holes 84,66 and 18 in the panel P1, the flange 46 and the flanges 16, respectively. Nuts 98 are threaded on to the bolts 20 to secure the members 6 and 10 fixedly about the assembly 8 and to secure the connector 2 fixedly to the panel P1 to which the weight of the bus bars 32 has now been transferred.

Figure 16:
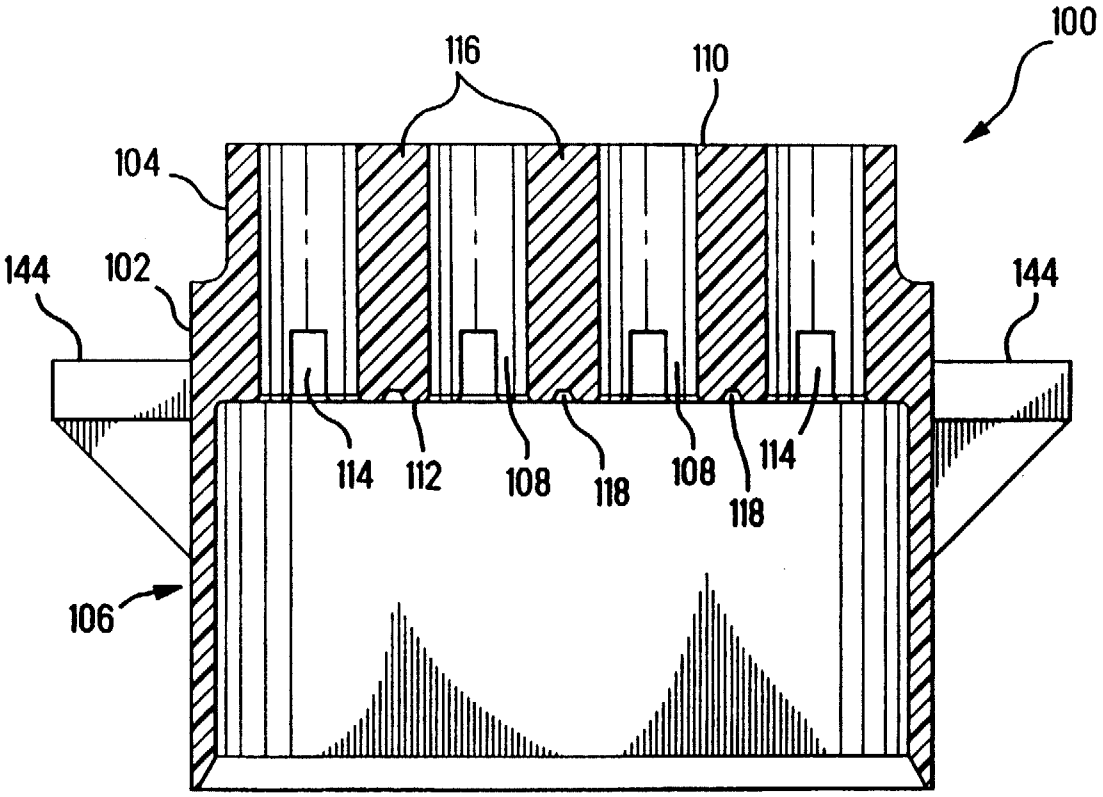
FIG. 16 is a view taken on the lines 16—16 of FIG. 7.

The mating connector 4 and its assembly to the panel P2 will now be described with a particular reference to FIGS. 7 to 16. The receptacle connector 4 comprises a one piece insulating housing 100 having a tab contact receiving rear part 102 from which projects rearwardly thereof, a lead receiving block 104, and forwardly thereof a shroud 106 for receiving the plug part 42 of the connector 2. As best seen in FIG. 16, four through cavities 108 extend through the housing part 102 and the block 104, each opening into a rear face 110 thereof and into an opposite tab contact receiving face 112 which forms the base of the shroud 106. In the upper wall each cavity 108 is a rectangular recess 114. The cavities 108 are separated by barrier walls 116, some of which are formed with a front plate locating groove 118 opening into the face 112.

Four tabs contacts 120 (only one of which is shown, in FIG. 7), each comprises a tab 122 and a crimping ferrule 124 crimped to an insulated electrical power lead 126. There projects outwardly from the rear end of the tab 122, adjacent to the ferrule 124, a rectangular anchoring lug 128.

Figure 14:
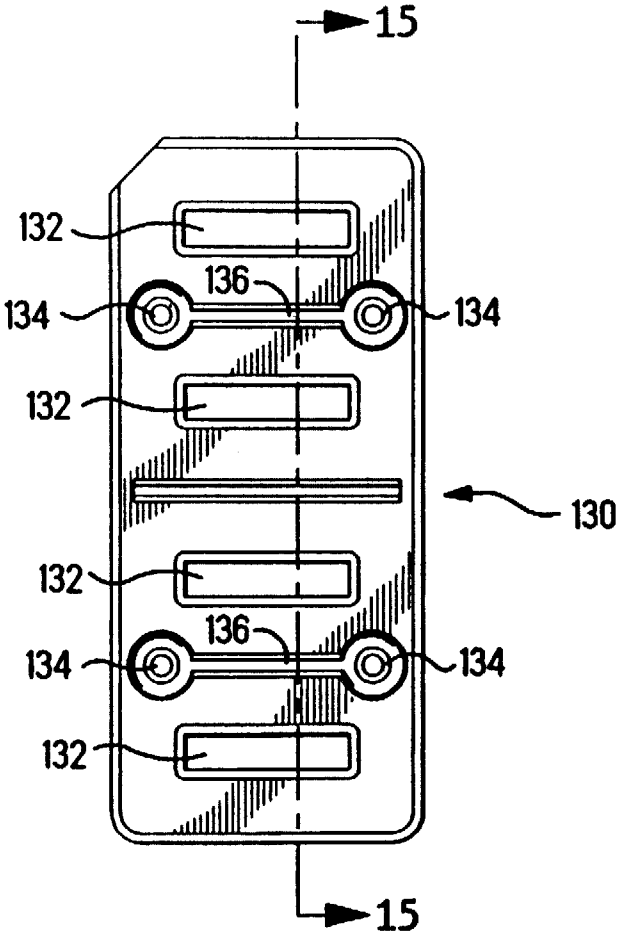
FIG. 14 is a plan view of a front cover plate of the receptacle connector.
Figure 15:
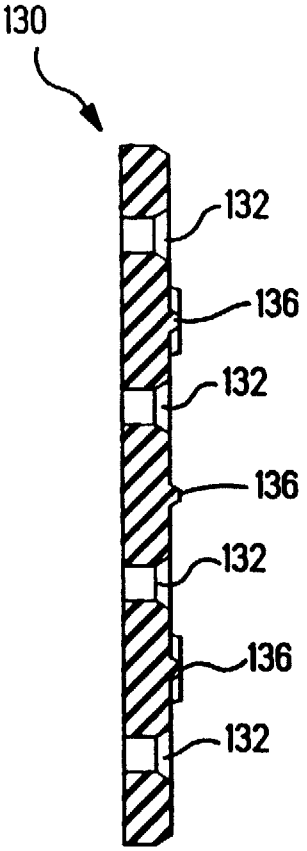
FIG. 15 is a view taken on the lines 15—15 of FIG. 14.
Figure 17:
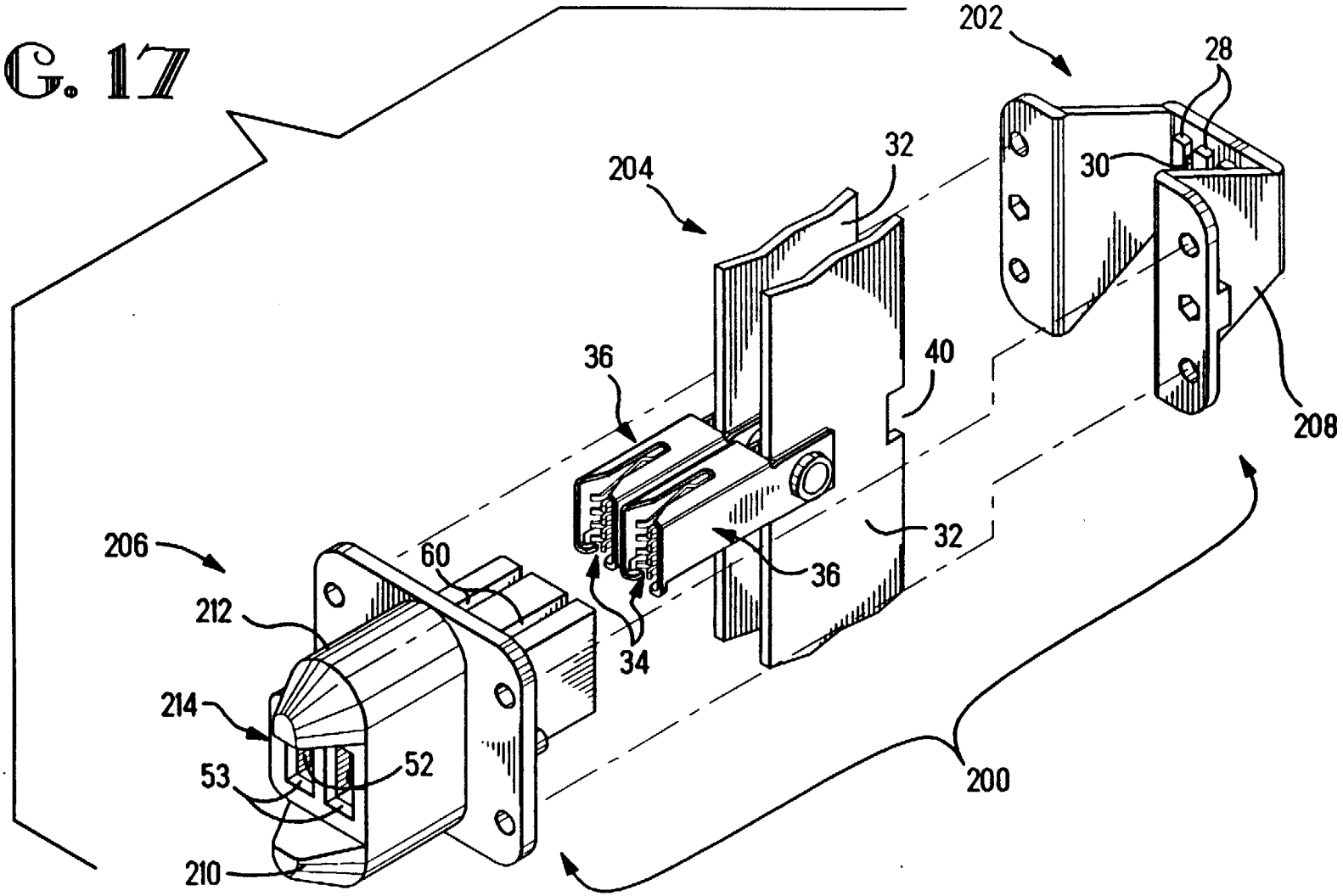
FIG. 17 is an exploded isometric view of a two position bus bar plug connector comprising a front insulating housing member, an intermediate bus bar and tulip contact assembly and a rear insulating housing member.
Figure 18:
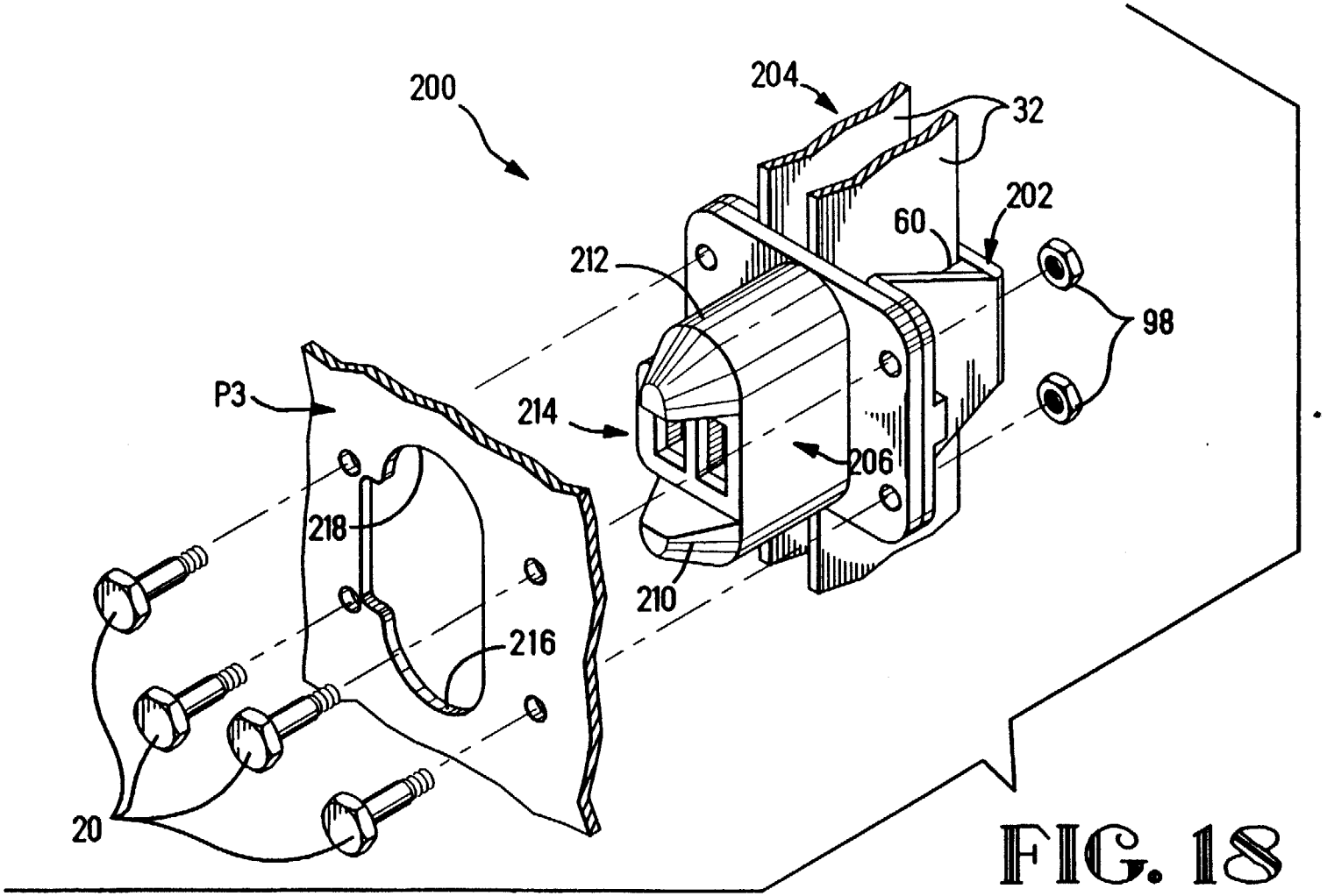
FIG. 18 is an exploded isometric view illustrating the connector of FIG. 17 when mounted to a third panel.

Each contact 120 is loaded into a respective cavity 108 by passing the lead 126 of the contact 120, through said respective cavity 108 by way of the face 112 in the shroud 106, so that the lead 126 extends beyond the rear face 110, and then pulling on the lead so that the lug 128 of the contact 120 lodges in the corresponding recess 114. As shown in FIGS. 14 and 15, a front cover plate 130 for receiving against face 112 has four rectangular apertures 132 therethrough, each for receiving therethrough a respective tab 122. Each aperture 132 has a beveled lead-in. Between each of two adjacent pairs of the apertures 132 are two spaced circular holes 134 and extending therebetween is a front cover plate guide rib 136. When the contacts 120 have been loaded into the cavities 108, as described above, the front plate 130 is located on the face 112 with tabs 122 extending through the apertures 132. Each rib 136 is received in a corresponding groove 118, after which the plate 130 is riveted on the face 112 by means of rivets passed through the holes 134 and into openings 135 (FIG. 7) in the rear housing part 102. The chordal surface 125 of ferrule 124 is wider than rectangular apertures 132 and secures contact 120 in connector 4.

Figure 8:
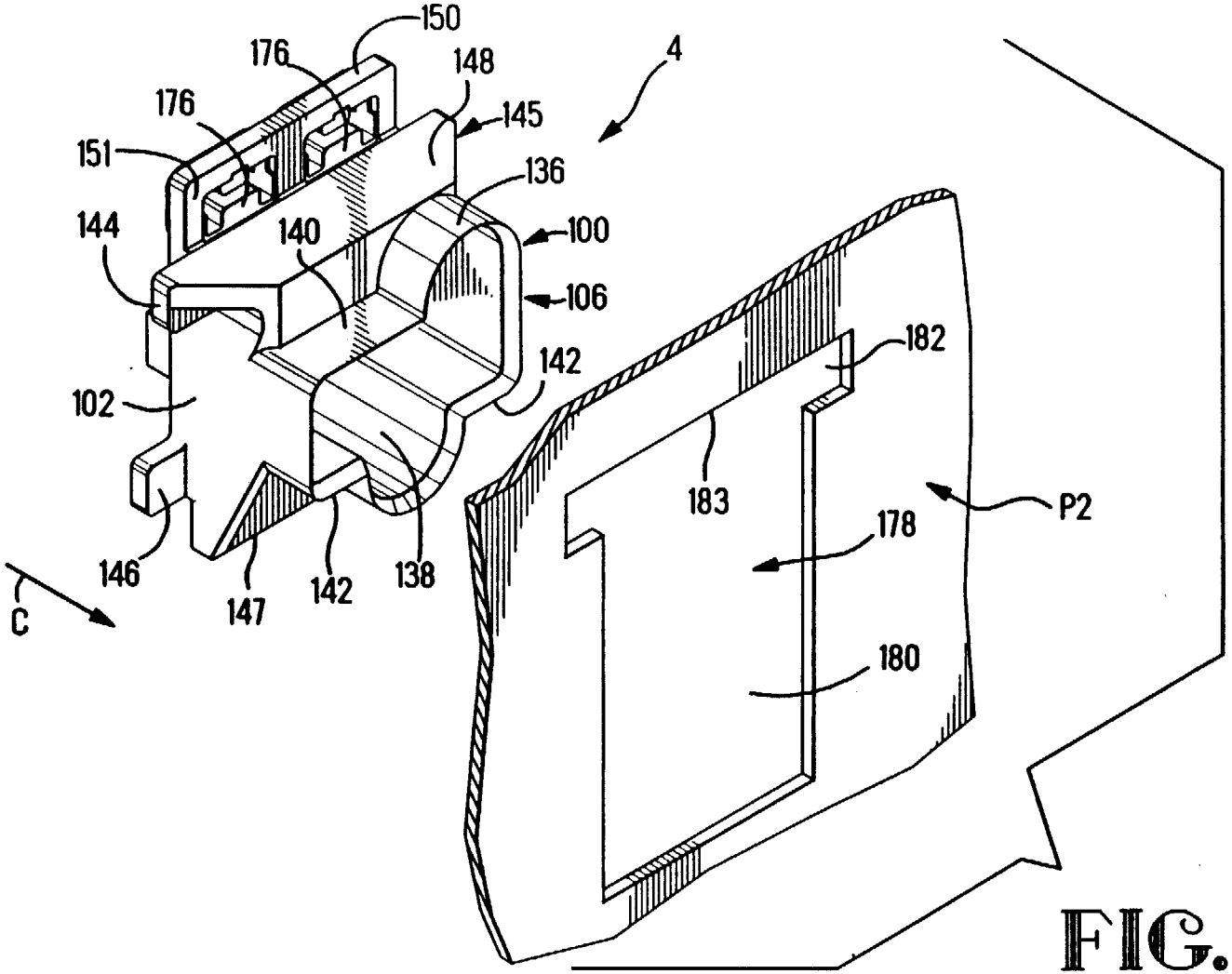
FIGS. 8 to 10 are isometric views illustrating respective consecutive steps in mounting the receptacle connector to a second panel.
Figure 9:
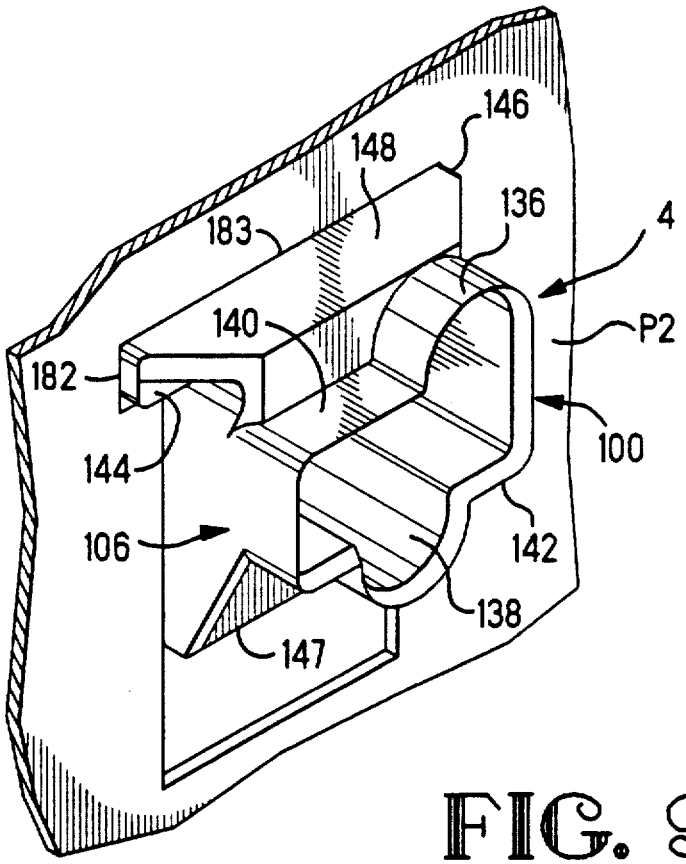
Figure 10:
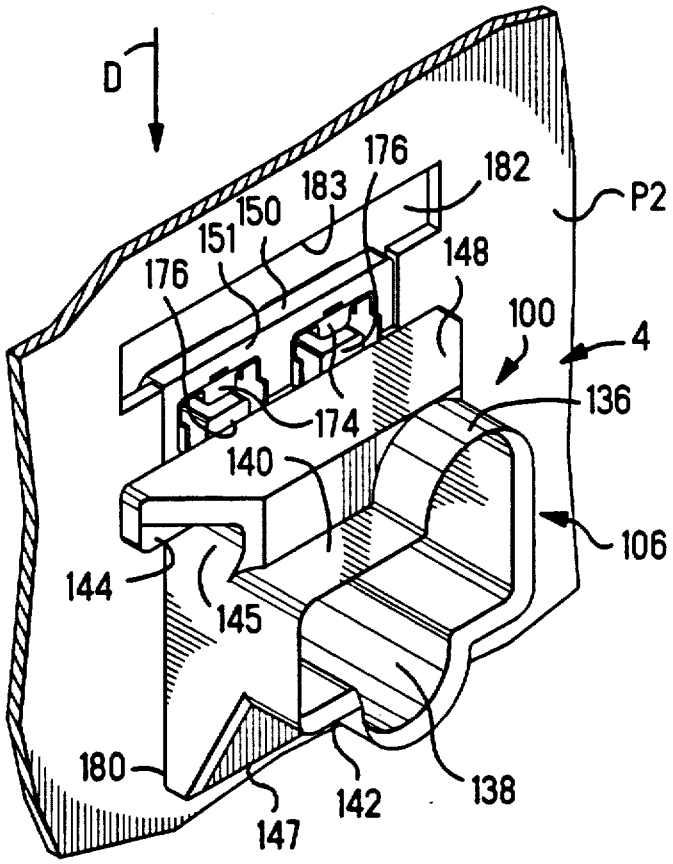

As best seen in FIGS. 8 to 10, the shroud 106 is formed with two arcuate alignment member receiving arcs 136 and 138, respectively, projecting upwardly, and downwardly, respectively, from respective top and bottom walls 140 and 142 of the shroud 106. The arc 136 is offset from the arc 138 longitudinally of the shroud 106, to the same extent that the alignment members 68 and 70 of the housing member 10 are offset from each other as described above. The alignment member receiving arcs 136 and 138 are dimensioned to receive the alignment members 68 and 78, respectively in a close fit.

There projects from the part 102 of the housing 100 panel engaging front upper flanges 144 and rear panel engaging lower flanges 146. The flanges 144 are spaced forwardly of the flanges 146 by a distance substantially the same as or slightly greater than the thickness of the panel P2, and are proximate to a bottom face 147 of the housing 100. The flanges 144 extend from opposite ends of a forward cross piece 145 on the housing part 102 and beyond the lateral ends of the part 102. There upstands from the housing part 102, above a top wall 148 of the cross piece 145, and rearwardly thereof, a latch member receiving flange 150 having two laterally spaced, through, latch member receiving sockets 152 of substantially rectangular cross section. Each socket 152 has on each of two opposite side walls 154 thereof, a rearwardly chamfered latching protrusion 156, and on a top wall 157 thereof, a rearwardly chamfered latching projection 158 (FIGS. 11 to 13) in a recess 160.

Figure 12:
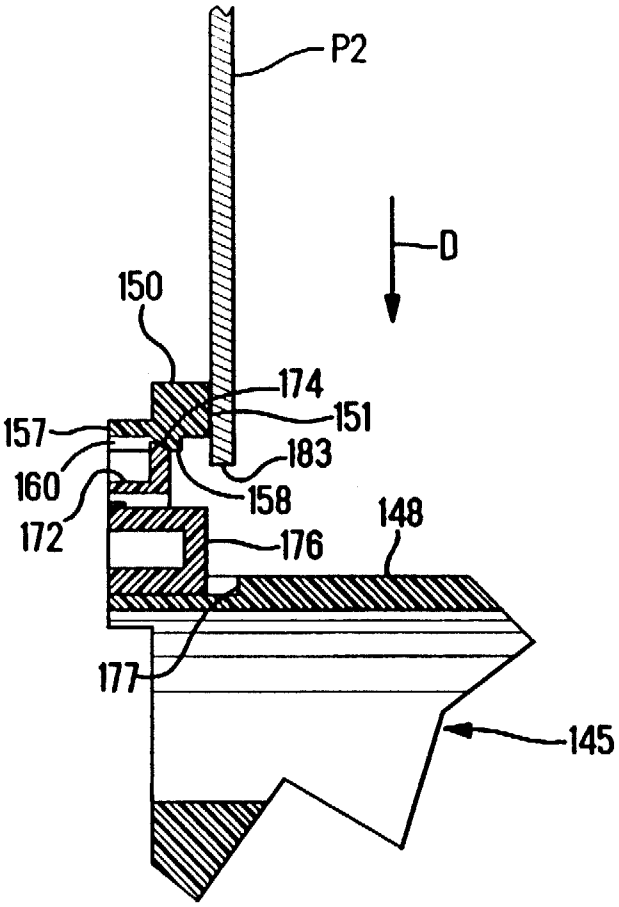
FIGS. 11 to 13 are fragmentary sectional views illustrating details of the receptacle connector when it is being mounted to the second panel.
Figure 11:
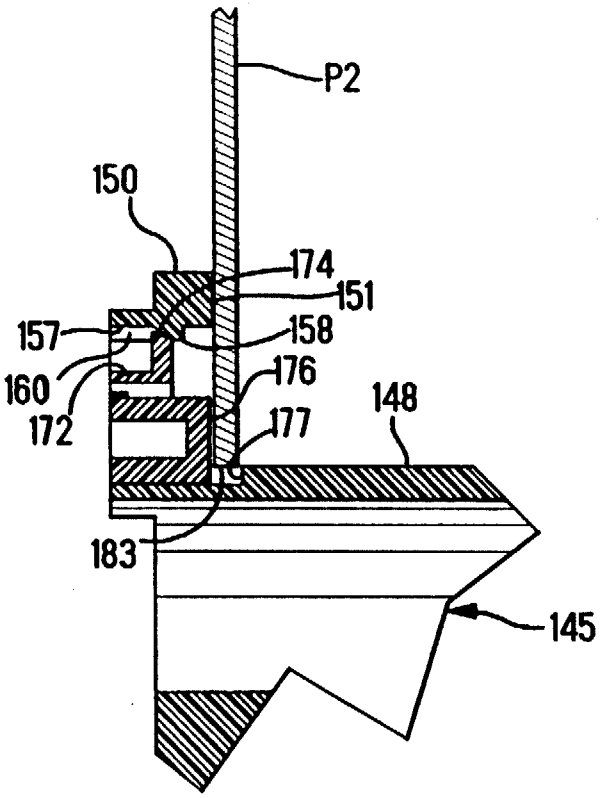
Figure 13:
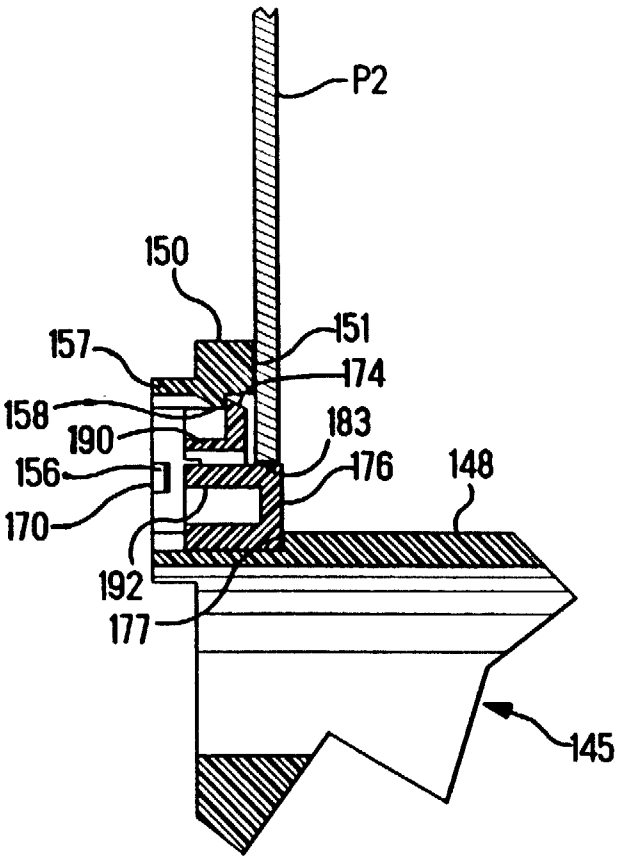

A panel lock member 162 factory loaded into each socket 152 comprises side walls 164 connected by a top wall 166 and a bottom wall 168. Each side wall 164 has a rearwardly opening latching slot 170 having a forward latching end 171. There is formed in the top wall 166 an L-shaped front latch 172 terminating in a latch bar 174. The bottom wall 168 is formed with a hollow substantially rectangular latch member 176 projecting forwardly beyond the latch bar 174. In front of the latch member 176, the top wall 148 of the cross piece 145 has a longitudinally extending stop shoulder 177 which is best seen in FIGS. 11 to 13. In the factory loaded, preload position of each panel lock member 162, the ends of the slots 170 of the panel lock member 162 are engaged in front of respective latching protrusion 156 in the respective socket 152, the latch bar 174 of each latch member 162 engaging a chamfered rearward edge of the respective latching projection 158. The latch bolt member 176 is thus in a withdrawn, rearward, position as shown in FIG. 11.

The panel P2 to which the connector 4 is to be mounted has a T shaped cut out 178 best seen in FIG. 8. The T shaped cutout has a wider upright part 180 and a narrower transverse part 182. The transverse part has a top edge 183. In order to mount the connector 4 to the panel P2, the connector 4 is moved towards the panel P2 from its rear side within the drawer, in the direction of the arrow C in FIG. 8, so that the shroud 106 projects through the upright part 180 of the cut out 178 and beyond the front face of the panel P2, the cross piece 145 extending through the transverse part 182 with the flanges 144 lying just in front of the panel 2. The flanges 146 engage against the rear face of the panel P2 and the front face 151 of the flange 150 also engages against the rear face of the panel P2 as is apparent from FIGS. 9 through 13.

As shown in FIGS. 10 and 12, the connector 4 is moved down towards the bottom of the upright part 180 of the cut out 178, as indicated by the arrows D in FIGS. 10 and 12, whereby the connector 4 is held in the cut out 178 by the engagement of the top front flanges 144 against opposite sides of the front face of the panel P2 and by the engagement of the bottom rear flanges 146 against opposite sides of the rear face of the panel P2. The connector 4 can, however, float upwardly and downwardly in the cut out 178, and to a lesser extent laterally therein. In order to prevent the connector 4 from being raised to the extent that the cross piece 145 is again located in the transverse part 182 of the cut out 178 so that the connector can fall out of the panel P2, the panel lock members 162 and thus the latch members 176 are advanced to a forward position, that is moved into the plane of panel P2 by means of a suitable tool to the position in which they are shown in FIGS. 10 and 13. As the latch bolts 176 are being so advanced the latch bars 174 of the latches 172 ride up the chamfered surfaces of the latching projections 158 and lodge in front of forward shoulders thereof as shown in FIG. 13, so that the latch bolt members 163 are retained in their advanced positions between the projections 158 and the stop shoulder 177. In the position, the latch members 176 project beyond the front face of the flange 150 into the plane of panel P2 with the lower parts of the forward ends of the latch bolt 176 engaging the stop shoulder 177.

The upward movement of the connector 4 in the cut out 178 is accordingly limited by the abutment of the forward parts of the top faces of the latch member 176 against the top edge 183 of the transverse part 182 of the cut out 178, as shown in FIG. 13. The cross piece 145 cannot, therefore, enter the part 182 to such an extent that the connector 4 can fall from the panel 2. Connector 4 can still shift toward surface 183 but to a lesser extent than when latch members 176 were in their factory loaded position.

If the connector 4 is to be removed from the panel 2, a tool, for example needle point pliers, can be used to grip oppositely facing surfaces 190 and 192 (FIG. 13) of the latch 172 and the latch member 176 of each panel lock member 162 in turn, thereby to release the latch bar 174 of each panel lock member 162 from the corresponding projection 158, so that the tool can be used to withdraw the panel lock member 162 to its rearward, factory loaded position in which it is held in place by the engagement of the latch bar 174 against the chamfered rear surface of the projection 158 and the engagement of the ends of the slots 170 in front of the respective latching protrusion 156.

When the connector 4 has been assembled to the panel P2 as described above, the leads 126 are connected to appropriate circuitry of the drawer module. The drawer can then be closed so that the connector 4 is mated with the connector 2 which is located in the rack and behind the rails on which the drawer moves. As the drawer is being closed, the connector 4 is mated with the connector 2 in the direction indicated by the arrow E in FIG. 7 (in which Figure the panels and the housing member 6 and assembly 8 of the connector 4 are not shown). Alignment members 68 and 78 of the connector 2 are received in the alignment member receiving arcs 136 and 138, respectively of the connector 4, guided by the noses 74 and 82 of the alignment members 68 and 78, respectively, thence alignment members 68 and 78 whereby each tab 122 of the connector 4 is mated with a respective tulip contact 34 of the connector 2 thereby connecting the bus bars 32 to the appropriate circuitry of the power supply module in the drawer. In the event of misalignment between the connectors 2 and 4, the tapered noses 74 and 82 of the alignment members 68 and 78 engage in the alignment member receiving arcs 136 and 138, respectively, of the connector 4 so as to bring the alignment member receiving arcs into alignment with the alignment members, given that the connector 4 can float both vertically and horizontally in the panel P2 although the connector 2 is affixed to the panel P, since the weight of the bus bars 32 would, in any event, not allow it to float. When the drawer is pulled out the connectors 2 and 4 are unmated.

Since the alignment members 68 and 78 and the alignment member receiving arcs 136 and 138 are offset in the manner described above, the connectors 2 and 4 can only be mated in a single correct orientation with respect to each other. If the housing member 10 were incorrectly mounted with its alignment member 78 uppermost to a panel having corresponding alignment member receiving arcs, the connector 2 could not be mated with the connector 4.

A two position version of the connector assembly described above, such as for connecting a DC power supply to a drawer mounted DC power supply module, will now be described with reference to FIGS. 17 to 21. In FIGS. 17 to 21, elements which are identical to those described above with reference to FIGS. 1 to 16, bear the same reference numerals as in those Figures.

Figure 19:
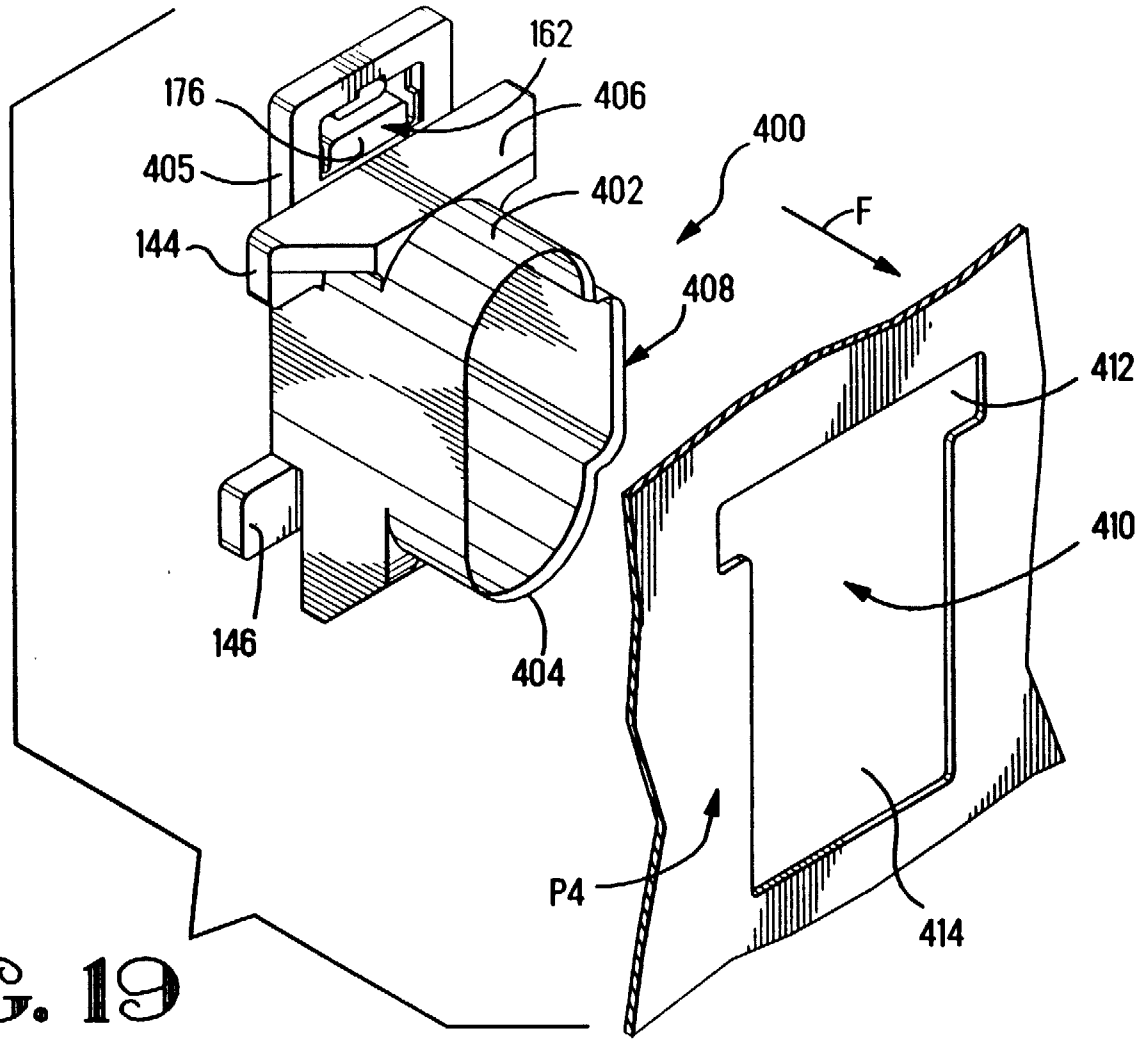
FIGS. 19 to 21 are isometric view illustrating respective consecutive steps in mounting a two position receptacle connector to a fourth panel, for mating with the connector of FIG. 17 and 18.
Figure 20:
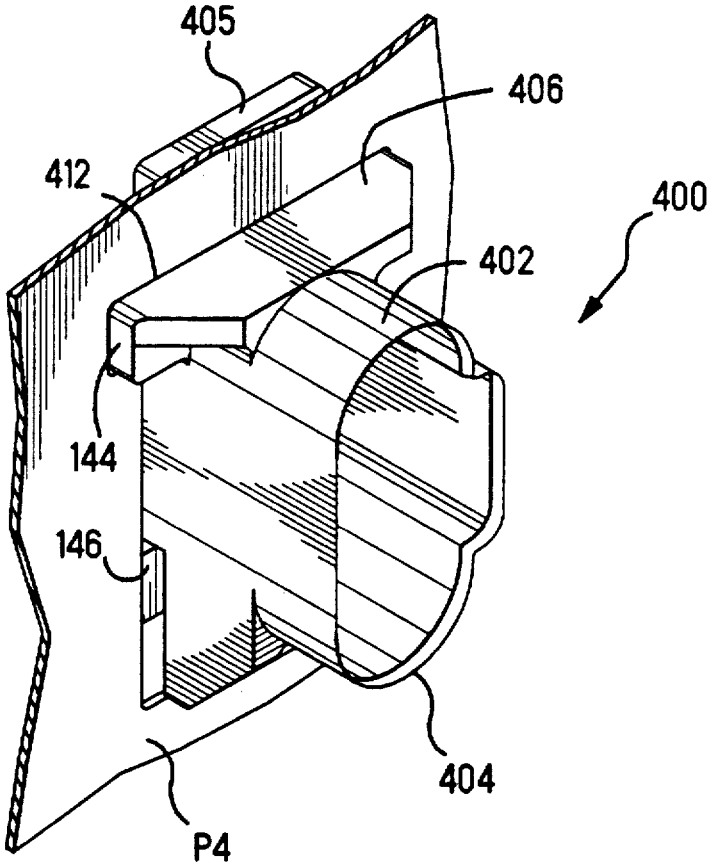
Figure 21:
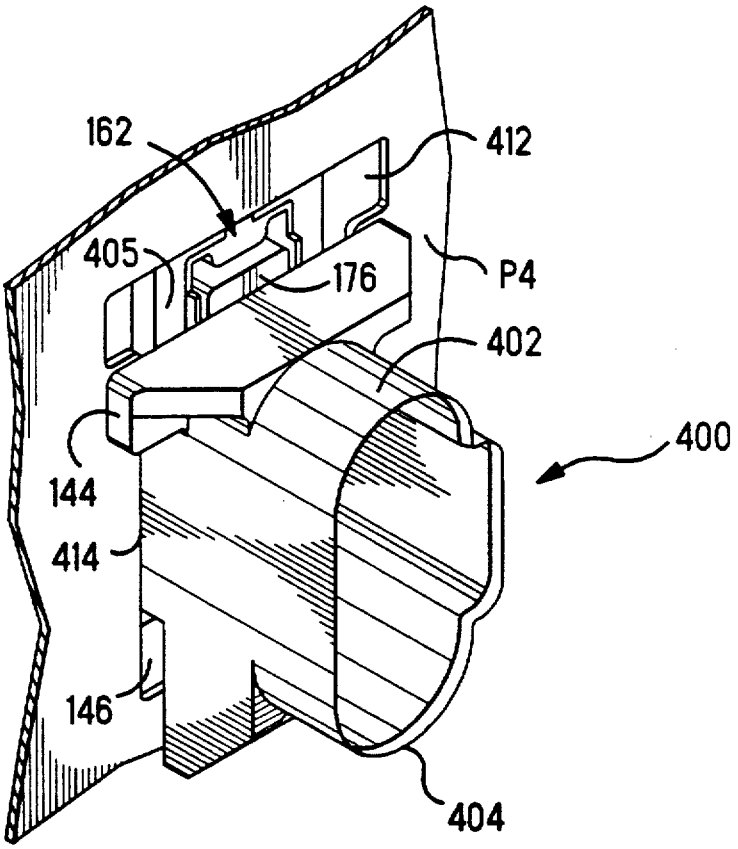

A plug connector 200 (FIGS. 17 and 18) is provided for mating with a receptacle connector 400 (FIGS. 19 to 21). The plug connector 200 comprises rear housing member 202 and a front housing member 206, and may include an intermediate tulip contact and bus bar assembly 204.

The rear housing member 202 differs from the rear housing member 6 described above, in that its back plate 208 has correspondingly only three merlons 28 and thus only two crenels 31 with ribs 30 therein. The assembly 204 differs from the assembly 8 in that it has correspondingly only two bus bars 32 and only two tulip contacts 34, the bus bars 32 being for connection to opposite poles of a DC power supply.

The front housing member 206 differs from the front housing member 10, in that is has only two pairs of slots 60, one for each bus bar 32 and only two cavities 52 each for receiving a tulip contact 34 and its cover 36. Also, the housing member 206, instead of the alignment members 68 and 78 has a pair of alignment members 210 and 212 positioned on either side of its forward housing part 214. Each alignment member 210 and 212 has a laterally outer rounded surface for engaging in a respective similarly configured alignment member receiving recess 216 and 218 in a panel P3. Likewise, the receptacle connector 400 has a pair of opposed alignment member receiving arcs 404 and 402 for receiving the alignment members 210 and 212, respectively, of the connector 200. In view of its reduced width, with respect to the connector 4, the connector 400 has but a single panel lock member 162 in its top flange 405. The connector 400 is mounted to a panel P4 the same way as the connector 4 is mounted to the panel P2, the cross piece 406 of the connector 400 and its shroud 408 being initially inserted in the direction of the arrow F in FIG. 19, through a T-shaped cut out 410 in the panel P4 with the cross piece 406 in the transverse part 412 of the cut out 410 and the shroud 408 in the upright part 414 of the cut out 410 as shown in FIG. 20. The connector 4 is then moved down in the cut out 410 as shown in FIGS. 19, 20 and 21 allowing the latch member 176 of the panel lock member 162 to be advanced, so that the connector 400 cannot be raised to an extent that it falls out of the panel P4.

While the connectors in the preferred embodiment have been described as having the structure to receive multiple bus bars and tulip contacts, a connector in accordance with the invention could have only one bus bar and thus only one tulip contact, the receptacle connector having only one tab contact; in this case a plurality of receptacle connectors could be mounted to the drawer back panel for mating with a like plurality of plug connectors.

The plug connector could be provided with male contacts, the receptacle connector being provided with female contacts.

The connector on the drawer back panel could be in the form of a plug connector, the connector for mating therewith being in the form of a receptacle connector.

While the preferred embodiment of the invention has been described with respect to a T shaped panel cut out having a vertical part and a transverse part, the cut out could be oriented at any angle with reference to the vertical. The disclosure has been of the preferred embodiment and is a matter of convenient disclosure.

I claim:

1. An electrical connector for electrically connecting at least one bus bar to an external electrical circuit, the connector comprising a bus bar and contact assembly and first and second elongate, opposed insulating housing members extending in the same direction, the bus bar and contact assembly comprising at least one bus bar with an electrical contact projecting from a first longitudinal edge thereof, the first insulating housing member receiving said electrical contact for mating with an electrical contact element connected to said external circuit, a notch being provided in a minor length of a second and opposite longitudinal edge of said at least one bus bar opposite to said electrical contact, and on the second insulating housing member a protrusion for engagement with said notch, and walls on said second insulating housing member to be engaged on opposite lateral surfaces of said bus bar and on opposite sides of said notch for supporting said at least one bus bar in said connector, wherein said longitudinal edges of said at least one bus bar extend transversely of the length of said housing members, said housing members cooperating to surround central minor lengths of said longitudinal edges in the region of the cooperating structure and said electrical contact of said at least one bus bar, with major lengths of said longitudinal edges projecting from between said housing members in opposite directions.

2. A connector as recited in claim 1, wherein said first housing member comprises at least one cavity receiving the electrical contact of said at least one bus bar and at least one pair of slots each communicating with said at least one cavity and opening towards the second housing member and receiving said at least one bus bar, said second housing member being secured to said first housing member and retaining said at least one bus bar in said at least one pair of slots in said first housing member.

3. An electrical connector for electrically connecting at least one bus bar to an external electrical circuit, the connector comprising a bus bar and contact assembly and first and second elongate, opposed insulating housing members extending in the same direction, the bus bar and contact assembly comprising at least one bus bar with an electrical contact projecting from a first longitudinal edge thereof, the first insulating housing member receiving said electrical contact for mating with an electrical contact element connected to said external circuit, cooperating structure being provided in a second and opposite longitudinal edge of said at least one bus bar, opposite to said electrical contact and on the second insulating housing member, for supporting said at least one bus bar in said connector, wherein said longitudinal edges of said at least one bus bar extend transversely of the length of said housing members, said housing members cooperating to surround central minor lengths of said longitudinal edges in the region of the cooperating structure and said electrical contact of said at least one bus bar, with major lengths of said longitudinal edges projecting from between said housing members in opposite directions, and said cooperating structure comprises: a rectangular notch in said opposite longitudinal edge, a pair of spaced merlons of given length and a rib in a crenel therebetween, the rib projecting from a surface of a plate of said second housing member, said rib projecting from said surface to a lesser extend than said merlons and being shorter than said merlons, the rib being received in said notch and the merlons engaging against opposite lateral surfaces of said at least one bus bar on either side of said notch.

4. An electrical connector for electrically connecting at least one bus bar to an external electrical circuit, the connector comprising a bus bar and contact assembly and first and second elongate, opposed insulating housing members extending in the same direction, the bus bar and contact assembly comprising at least one bus bar with an electrical contact projecting from a first longitudinal edge thereof, the first insulating housing member receiving said electrical contact for mating with an electrical contact element connected to said external circuit, cooperating structure being provided in a second and opposite longitudinal edge of said at least one bus bar, opposite to said electrical contact and on the second insulating housing member, for supporting said at least one bus bar in said connector, wherein said longitudinal edges of said at least one bus bar extend transversely of the length of said housing members, said housing members cooperating to surround central minor lengths of said longitudinal edges in the region of the cooperating structure and said electrical contact of said at least one bus bar, with major lengths of said longitudinal edges projecting from between said housing members in opposite directions, said second housing member comprises a back plate having projections thereon, said second longitudinal edge having means cooperating with said projections for supporting said at least one bus bar, said back plate having opposite ends from each of which projects a planar mounting lug terminating in a mounting flange, said first housing member having a peripheral flange for engagement with the flanges of the second housing member, said housing members being securable together and to a mounting panel, said mounting lugs extending from said ends in aligned substantially parallel, facing, relationship and cooperating to enclose said at least one bus bar, laterally, and coextensively with said central minor lengths.

5. A connector as claimed in claim 4, wherein the flange of one of said housing members comprises a circular cross sections projection for receipt in a hexagonal recess in the flange of the other housing member in an interference fit, whereby the two housing members are secured together.

6. An electrical connector for connecting a plurality of bus bars to an external electrical circuit, the connector comprising:

a rear insulating housing member having a wall from which projects a plurality of pairs of spaced first projections and between the projections of each pair, a second projection;

a bus bar and contact assembly comprising, a plurality of bus bars each having a front longitudinal edge, an electrical contact element projecting from said edge normally of the bus bar and being fastened thereto, each bus bar having a support surface proximate a rear longitudinal edge;

a front insulating housing member having cavities therethrough each for receiving a respective one of said contacts, said front housing member having a pair of rearwardly opening slots communicating with said cavities for receiving a respective one of said bus bars; and cooperating structure on said front and rear housing members for connecting said housing members together about said bus bar and contact assembly, whereby each of said second projections engages the support surface of a respective bus bar, the first projections disposed on either side of each second projection engaging opposite lateral surfaces of said respective bus bar, said projections serving to support said bus bars in the connector, and said bus bars being received in said slots, and wherein each electrical contact comprises a metal cover having a leg secured to the respective bus bar, the support surfaces comprise notches in the rear longitudinal edge of the bus bar, the notches of the bus bars being identical and being positioned in alignment transversely of the bus bars, and each notch being disposed opposite to a respective one of said covers.

7. A connector as recited in claim 6, wherein the first and second projections extend vertically across said wall, the second projections being shorter than the first projections and projecting from said wall to a lesser extend than said first projections, each first projection being dimensioned for reception against the support surface of a respective bus bar.

8. A connector as recited in claim 6, wherein said rear housing member surrounds said bus bars and retains said bus bars in said slot of the front housing member.

9. An electrical connector for connecting a plurality of bus bars to an external electrical circuit, the connector comprising:

a rear insulating housing member having a wall from which projects a plurality of pairs of spaced first projections and between the projections of each pair, a second projection;

a bus bar and contact assembly comprising, a plurality of bus bars each having a front longitudinal edge, an electrical contact element projecting from said edge normally of the bus bar and being fastened thereto, each bus bar having a support surface proximate a rear longitudinal edge;

a front insulating housing member having cavities therethrough each for receiving a respective one of said contacts, said front housing member having pairs of rearwardly opening slots communicating with said cavities each of said pairs for receiving a respective one of said bus bars; and cooperating structure on said front and rear housing members for connecting said housing members together about said bus bars and contact assembly, whereby each of said second projections engages the support surface of a respective bus bar, the first projections disposed on either side of each second projection engaging opposite lateral surfaces of said respective bus bar, said projections serving to support said bus bars in the connector, and said bus bars being received in said slots, and wherein said housing members are secured to a mounting panel by means of fasteners extending through holes in respective flanges of said housing members, whereby said bus bars are supported by said panel.

10. An electrical connector assembly for making and breaking a power supply to electrical circuitry, the connector assembly comprising:

an electrical bus bar first connector supporting a plurality of electrical bus bars in parallel aligned relationship, each bus bar having extending normally from a front longitudinal edge thereof a first electrical contact having a mating portion; a front insulating housing member having a through cavity for receiving each said mating portion and pairs of slots opening rearwardly of the front housing member, each pair of said slots communicating with a respective cavity for receiving a respective bus bar;

a rear insulating housing member having means for attachment to the front insulating housing member to retain said bus bars in said slots; and means on said rear housing member for cooperation with means provided on rear edges of said bus bars for supporting said bus bars in said first connector;

a second electrical connector for mating with the first electrical connector and having a plurality of through cavities each for receiving a second electrical contact having a mating portion for mating with the mating portion of a respective first contact of the first connector when said first and second electrical connectors are mated;

a first mounting panel having a cut out for receiving a mating part of said front housing member;

a second mounting panel having a cut out for receiving a mating part of said second electrical connector; and means on said first panel and said front housing member for fixedly securing said first panel thereto; and means on said second electrical connector for allowing it to float in the cut out of said second panel to allow the first and second connectors to be mated despite misalignment between the mating parts thereof.

11. An assembly as recited in claim 10, wherein the mating portion of each first contact is in the form of a receptacle, the mating portion of each second contact being in the form of a tab for mating with such receptacle, each receptacle having a metal cover which is slotted to receive the respective tab and from which project a pair of legs receiving the respective bus bar between them and being secured thereto.

12. An assembly as recited in claim 10, wherein the rear edge of each bus bar is formed with a notch for receiving a projection on said rear housing member, said rear housing member having further projections for engaging the respective bus bar on opposite sides of the notch therein.

13. An insulating housing member for receiving a plurality of electrical receptacles each projecting normally of, and being electrically connected to, a longitudinal edge of a respective bus bar, the housing member comprising a forward plug part having a mating face, a rear part having a bus bar receiving face and a peripherally projecting flange intermediate said faces, the housing member defining a plurality of through cavities each opening into both said faces, said rear part defining a row of first slots opening into an upper face of said rear part, and each communicating with a respective one of said cavities and a row of second slots opening into the lower face of said rear part and each communicating with a respective one of said cavities, each of said first and second slots also opening into said bus bar receiving face and each first slot being aligned with a respective second slot, one of said receptacles being insertable into each a respective cavity by way of said bus bar receiving face so as to lie forwardly of said flange with the bus bar secured to that receptacle being received in the first and second slots communicating with that cavity.

14. A housing member as recited in claim 13, wherein said flange is planar and all of said slots and said cavities extend normally of said flange, the first slots being parallel with one another and said second slots also being parallel with one another.

15. A rear insulating housing member for connection to a front insulating housing member to support a plurality of bus bars each having a notch formed in a rear longitudinal edge thereof, the rear housing member comprising a planar back plate having opposite ends, a mounting lug projecting from each of said ends, said mounting lugs extending from said ends in aligned, substantially parallel, facing, relationship, each lug terminating in a mounting flange extending substantially parallel to the back plate and having at least one through hole therein for receiving a fastener for securing said flange to said front housing member, the back plate having a front surface between said mounting lugs and on said front surface a row of parallel spaced merlons and between each adjacent pair of said merlons a rib therebetween, for reception in the notch a respective of bus bar, the merlons of each adjacent pair projecting from said front face and in parallel relationship with said mounting flanges, to a greater extent than the rib between those merlons, for engaging said respective bus bar on either side of the notch therein.

16. A rear housing member as recited in claim 15, wherein each mounting flange is formed with a hexagonal aperture extending into a rear projection behind said flange, for receiving a protrusion on said front housing member with a forced fit.

17. An electrical connector for electrically connecting at least one bus bar to an external circuit, the bus bar having first and second opposed minor longitudinal edges and opposed major lateral surfaces, the at least one bus bar having a contact extending beyond the first minor longitudinal edge, the connector comprising:

a first dielectric housing member defining a mating face and having a contact receiving cavity extending rearwardly therefrom, said cavity being adapted to receive the contact on the bus bar, said housing member having first and second flange members extending laterally from said contact receiving cavity, and a second dielectric housing member securable to the first and second flange members about the bus bar, whereby the electrical connector encircles the bus bar at the location at which the connector is positioned;

wherein the second dielectric housing member comprises a mounting plate having opposite ends and a planar mounting lug projecting from each of said ends, said mounting lugs extending from said ends towards the first dielectric housing member in aligned, substantially parallel, facing relationship on opposite sides of, and in facing relationship with, said opposed major lateral surfaces of said at least one bus bar, each mounting lug terminating in a mounting flange secured to a respective one of said flange members of said first housing member.

18. An electrical connector as recited in claim 17, wherein the bus bar has a support surface proximate the second minor longitudinal edge, one of said first and second housing members comprising a support shoulder engageable with the support surface to support the at least one bus bar when the bus bar is received in the connector.

19. An electrical connector as recited in claim 18, wherein the housing member having the support shoulder therein is the second housing member.

20. An electrical connector as recited in claim 18, wherein the support surface in the bus bar is in the form of a notch, and wherein the support shoulder on one of the first and second housing members comprises a rib extending from a surface of the second housing member.

21. An electrical connector for electrically connecting at least one bus bar to an external electrical circuit, the connector comprising a bus bar and contact assembly and first and second insulating housing members surrounding said assembly, the bus bar and contact assembly comprising at least one bus bar with an electrical contact projecting from a first longitudinal edge thereof, the first insulating housing member receiving said electrical contact for mating with an electrical contact element connected to said external circuit, cooperating structure being provided in a second and opposite longitudinal edge of said at least one bus bar and on the second insulating housing member for supporting said bus bar in said connector, wherein said housing members are secured to a mounting panel by means of fasteners extending through respective holes in respective flanges of said housing members.

22. An electrical connector for electrically connecting at least one bus bar to an external electrical circuit, the connector comprising a bus bar and contact assembly and first and second insulating housing members surrounding said assembly, the bus bar and contact assembly comprising at least one bus bar with an electrical contact projecting from a first longitudinal edge thereof, the first insulating housing member receiving said electrical contact for mating with an electrical contact element connected to said external circuit, cooperating structure being provided in a second and opposite longitudinal edge of said at least one bus bar and on the second insulating housing member for supporting said bus bar in said connector, said electrical contact comprising a metal cover having at least one leg secured to said at least one bus bar, the metal cover having a slot opening away from said at least one bus bar, for receiving said electrical contact element.

23. An electrical connector for electrically connecting at least one bus bar to an external circuit, the bus bar having first and second opposed minor longitudinal edges and opposed major lateral surfaces, the at least one bus bar having a contact extending beyond the first minor longitudinal edge, the connector comprising:

a first dielectric housing member defining a mating face and having a contact receiving cavity extending rearwardly therefrom, said cavity being adapted to receive the contact on the bus bar, said housing having first and second flange members extending laterally from said contact receiving cavity, and a second dielectric housing member securable to the first and second flange members about the bus bar, whereby the electrical connector encircles the bus bar at the location at which the connector is positioned, said contact being in the form of a receptacle for mating with a tab, the receptacle having a metal cover which is slotted to receive the tab and from which project a pair of legs receiving said at least one bus bar and being secured thereto.

24. An electrical connector for electrically connecting at least one bus bar to an external circuit, the bus bar having first and second opposed minor longitudinal edges and opposed major lateral surfaces, the at least one bus bar having a contact extending beyond the first minor longitudinal edge, the connector comprising:

a first dielectric housing member defining a matching face and having a contact receiving cavity extending rearwardly therefrom, said cavity adapted to receive the contact on the bus bar, said housing having first and second flange members extending laterally from said contact receiving cavity, and a second dielectric housing member securable to the first and second flange members about the bus bar, whereby the electrical connector encircles the bus bar at the location at which the connector is positioned, the second minor longitudinal edge having a notch therein receiving a projection on said second housing member, said second housing member having further projections engaging said major lateral surfaces of said at least one bus bar on opposite sides of said notch.

* * * * *

UNITED STATES PATENT AND TRADEMARK OFFICE

CERTIFICATE OF CORRECTION

PATENT NO. : 5,213,518

DATED : May 25, 1993

INVENTOR(S) : Weidler

It is certified that error appears in the above-identified patent and that said Letters Patent is hereby corrected as shown below:

Claim 3, Column 10, Line 52 - "extend" should be --extent--

Claim 7, Column 12, Line 5 - "extend" should be --extent--

Signed and Sealed this

Fourteenth Day of March, 1995

*Attest:*

*Attesting Officer*

Bruce Lehman

BRUCE LEHMAN

*Commissioner of Patents and Trademarks*